US010968767B2

(12) United States Patent
Pratt et al.

(10) Patent No.: US 10,968,767 B2
(45) Date of Patent: Apr. 6, 2021

(54) NESTED DIRECT VANE ANGLE MEASUREMENT SHAFT

(71) Applicant: United Technologies Corporation, Farmington, CT (US)

(72) Inventors: William S. Pratt, West Hartford, CT (US); Martin Richard Amari, Glastonbury, CT (US); Steven D. Roberts, Moodus, CT (US); Ryan M. Stanley, Quaker Hill, CT (US)

(73) Assignee: RAYTHEON TECHNOLOGIES CORPORATION, Farmington, CT (US)

( * ) Notice: Subject to any disclaimer, the term of this patent is extended or adjusted under 35 U.S.C. 154(b) by 387 days.

(21) Appl. No.: 15/968,058

(22) Filed: May 1, 2018

(65) Prior Publication Data

US 2019/0338665 A1 Nov. 7, 2019

(51) Int. Cl.
*F01D 17/16* (2006.01)

(52) U.S. Cl.
CPC ..... *F01D 17/162* (2013.01); *F05D 2260/50* (2013.01)

(58) Field of Classification Search
None
See application file for complete search history.

(56) References Cited

U.S. PATENT DOCUMENTS

| | | | | |
|---|---|---|---|---|
| 4,755,104 | A | 7/1988 | Castro et al. | |
| 2014/0147245 | A1* | 5/2014 | Payne | F01D 17/14 415/1 |
| 2016/0040550 | A1 | 2/2016 | Do et al. | |
| 2016/0273378 | A1 | 9/2016 | Henson | |

FOREIGN PATENT DOCUMENTS

| | | | |
|---|---|---|---|
| EP | 2006495 | A1 | 12/2008 |
| EP | 2383439 | A2 | 11/2011 |
| EP | 2735743 | A2 | 5/2014 |
| JP | 2015175328 | A | 10/2015 |
| WO | 2014158455 | A1 | 10/2014 |

OTHER PUBLICATIONS

The Extended European Search Report for Application No. 19160412.3-1006; dated May 28, 2019; dated Jun. 13, 2019; 8 pages.

* cited by examiner

*Primary Examiner* — Kayla McCaffrey
(74) *Attorney, Agent, or Firm* — Cantor Colburn LLP

(57) ABSTRACT

A variable vane actuation system of a gas turbine engine is provided. The variable vane actuation system including: a variable vane; a vane stem operably associated with the variable vane, wherein the variable vane is configured to rotate with the vane stem; a vane arm having vane stem end and a vane pin end opposite the vane stem end, the vane arm being operably connected to the vane stem at the vane stem end; and a rotational variable differential transformer operably connected to the vane stem, the rotational variable differential transformer configured to detect an amount of rotation of the vane stem.

17 Claims, 5 Drawing Sheets

NESTED DIRECT VANE ANGLE MEASUREMENT SHAFT

STATEMENT OF FEDERAL SUPPORT

This invention was made with Government support under contract FA8626-16-C-2139 awarded by the United States Air Force. The Government has certain rights in the invention.

BACKGROUND

The subject matter disclosed herein generally relates to variable vanes for variable vane actuation systems of gas turbine engines and, more particularly, to a method and apparatus for detecting angular rotation of variable vane arms for variable vane actuation systems of gas turbine engines.

A gas turbine engine typically includes a fan section, a compressor section, a combustor section and a turbine section. Air entering the compressor section is compressed and delivered into the combustion section where it is mixed with fuel and ignited to generate a high-speed exhaust gas flow. The high-speed exhaust gas flow expands through the turbine section to drive the compressor and the fan section. The compressor section typically includes low and high pressure compressors, and the turbine section includes low and high pressure turbines.

Vanes are provided between rotating blades in the compressor and turbine sections. Moreover, vanes are also provided in the fan section. In some instances the vanes are movable to tailor flows to engine operating conditions. Variable vanes are mounted about a pivot and are attached to an arm that is in turn actuated to adjust each of the vanes of a stage. A specific rotation of the vane is required to assure that each vane in a stage is adjusted as desired to provide the desired engine operation.

SUMMARY

According to an embodiment, a variable vane actuation system of a gas turbine engine is provided. The variable vane actuation system including: a variable vane; a vane stem operably associated with the variable vane, wherein the variable vane is configured to rotate with the vane stem; a vane arm having vane stem end and a vane pin end opposite the vane stem end, the vane arm being operably connected to the vane stem at the vane stem end; and a rotational variable differential transformer operably connected to the vane stem, the rotational variable differential transformer configured to detect an amount of rotation of the vane stem.

In addition to one or more of the features described herein, or as an alternative, further embodiments may include: an actuator operably connected to vane arm at the vane pin end.

In addition to one or more of the features described herein, or as an alternative, further embodiments may include: a torque tube operably connected to the actuator; a series of mechanical linkages operably connected to the torque tube; and an actuation ring operably connecting the series of mechanical linkages to the vane arm at the vane pin end.

In addition to one or more of the features described herein, or as an alternative, further embodiments may include that the actuator is configured to be located outside of an engine casing.

In addition to one or more of the features described herein, or as an alternative, further embodiments may include that the actuator is a linear actuator.

In addition to one or more of the features described herein, or as an alternative, further embodiments may include that the rotational variable differential transformer is configured to be located outside of an engine casing.

In addition to one or more of the features described herein, or as an alternative, further embodiments may include that the rotational variable differential transformer is operably connected to the vane stem through one or more shafts.

In addition to one or more of the features described herein, or as an alternative, further embodiments may include that the rotational variable differential transformer is operably connected to the vane stem through one or more shafts passing through the torque tube.

In addition to one or more of the features described herein, or as an alternative, further embodiments may include: a first shaft operably connected to the vane stem; and a second shaft operably connecting the first shaft to the rotational variable differential transformer.

In addition to one or more of the features described herein, or as an alternative, further embodiments may include: an actuator operably connected to vane arm at the vane pin end; a torque tube operably connected to the actuator; a series of mechanical linkages operably connected to the torque tube; and an actuation ring operably connecting the series of mechanical linkages to the vane arm at the vane pin end, wherein the first shaft and the second shaft pass through the torque tube.

In addition to one or more of the features described herein, or as an alternative, further embodiments may include that the first shaft further includes: a first end operably connected to the vane stem; and a second end opposite the first end operably connecting the first shaft to the second shaft, and the second shaft further includes: a first end of the second shaft operably connected to the second end of the first shaft; and a second end of the second shaft opposite the first end of the second shaft, the second end of the second shaft operably connecting the second shaft to the rotational variable differential transformer.

In addition to one or more of the features described herein, or as an alternative, further embodiments may include that the first end of the second shaft and the second end of the first shaft operably connect to form a spline joint.

In addition to one or more of the features described herein, or as an alternative, further embodiments may include that the first end of the second shaft is a female portion of the spline joint and the second end of the first shaft is a male portion of the spline joint that operably connects to the female portion.

In addition to one or more of the features described herein, or as an alternative, further embodiments may include that the first shaft is operably connected to the vane stem through the vane stem end of the vane arm.

In addition to one or more of the features described herein, or as an alternative, further embodiments may include that the first shaft further includes: a tubular portion located at the first end of the first shaft, the tubular portion being configured to fit around the vane stem end of the vane arm, wherein a portion of the vane stem end is contained within the tubular portion.

In addition to one or more of the features described herein, or as an alternative, further embodiments may include that the tubular portion is configured to interlock around the vane stem end of the vane arm such that as the vane arm rotates the vane stem.

In addition to one or more of the features described herein, or as an alternative, further embodiments may include that the second shaft includes a circular body having an outer diameter about equal to or less than an inner diameter of an inner diameter of the torque tube.

In addition to one or more of the features described herein, or as an alternative, further embodiments may include that the first shaft further comprises: a first end operably connected to the vane stem; and a second end opposite the first end operably connecting the first shaft to the second shaft, the second shaft further includes: a first end of the second shaft operably connected to the second end of the first shaft; and a second end of the second shaft opposite the first end of the second shaft, the second end of the second shaft operably connecting the second shaft to the rotational variable differential transformer, and the circular body is located proximate the first end of the second shaft.

In addition to one or more of the features described herein, or as an alternative, further embodiments may include that the circular body is concentric with the second shaft.

According to another embodiment, a method of controlling airflow through a core flow path of a gas turbine engine is provided. The method including: rotating a vane stem of a variable vane using an actuator operably connected to the vane stem through a vane arm having vane stem end and a vane pin end opposite the vane stem end, the vane arm being operably connected to the vane stem at the vane stem end and the vane arm being operably connected to the actuator at the vane pin end, the variable vane rotates with the vane stem; detecting an amount of rotation of variable vane using a rotational variable differential transformer operably connected to the vane stem; and rotating the vane stem of the variable vane in response to the amount of rotation detected.

The foregoing features and elements may be combined in various combinations without exclusivity, unless expressly indicated otherwise. These features and elements as well as the operation thereof will become more apparent in light of the following description and the accompanying drawings. It should be understood, however, that the following description and drawings are intended to be illustrative and explanatory in nature and non-limiting.

BRIEF DESCRIPTION OF THE DRAWINGS

The following descriptions should not be considered limiting in any way. With reference to the accompanying drawings, like elements are numbered alike.

DETAILED DESCRIPTION

A detailed description of one or more embodiments of the disclosed apparatus and method are presented herein by way of exemplification and not limitation with reference to the Figures.

Figure 1:
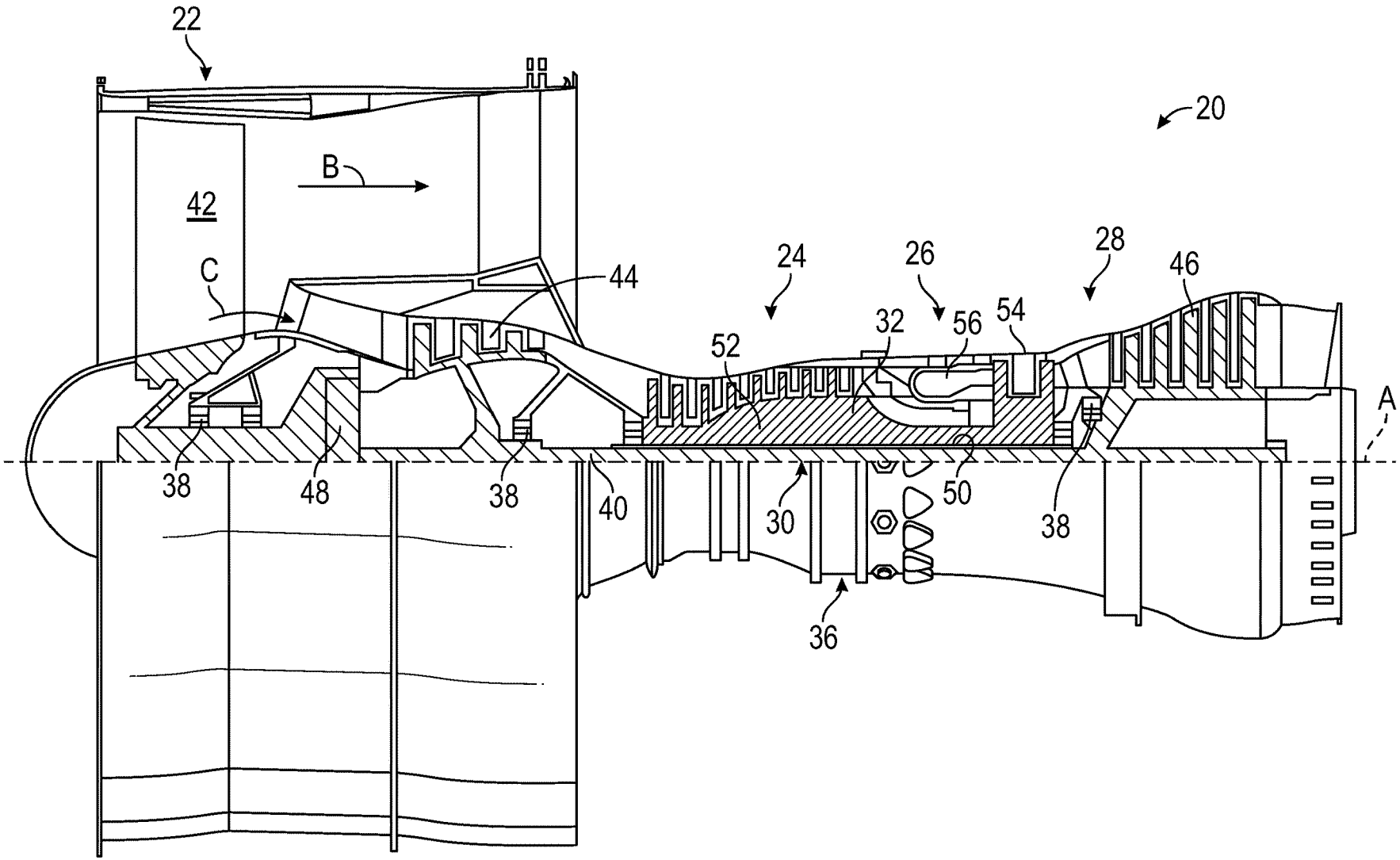
FIG. 1 is a partial cross-sectional illustration of a gas turbine engine, in accordance with an embodiment of the disclosure.

FIG. 1 schematically illustrates a gas turbine engine 20. The gas turbine engine 20 is disclosed herein as a two-spool turbofan that generally incorporates a fan section 22, a compressor section 24, a combustor section 26 and a turbine section 28. Alternative engines might include an augmentor section (not shown) among other systems or features. The fan section 22 drives air along a bypass flow path B in a bypass duct, while the compressor section 24 drives air along a core flow path C for compression and communication into the combustor section 26 then expansion through the turbine section 28. Although depicted as a two-spool turbofan gas turbine engine in the disclosed non-limiting embodiment, it should be understood that the concepts described herein are not limited to use with two-spool turbofans as the teachings may be applied to other types of turbine engines including three-spool architectures.

The exemplary engine 20 generally includes a low speed spool 30 and a high speed spool 32 mounted for rotation about an engine central longitudinal axis A relative to an engine static structure 36 via several bearing systems 38. It should be understood that various bearing systems 38 at various locations may alternatively or additionally be provided, and the location of bearing systems 38 may be varied as appropriate to the application.

The low speed spool 30 generally includes an inner shaft 40 that interconnects a fan 42, a low pressure compressor 44 and a low pressure turbine 46. The inner shaft 40 is connected to the fan 42 through a speed change mechanism, which in exemplary gas turbine engine 20 is illustrated as a geared architecture 48 to drive the fan 42 at a lower speed than the low speed spool 30. The high speed spool 32 includes an outer shaft 50 that interconnects a high pressure compressor 52 and high pressure turbine 54. A combustor 56 is arranged in exemplary gas turbine 20 between the high pressure compressor 52 and the high pressure turbine 54. An engine static structure 36 is arranged generally between the high pressure turbine 54 and the low pressure turbine 46. The engine static structure 36 further supports bearing systems 38 in the turbine section 28. The inner shaft 40 and the outer shaft 50 are concentric and rotate via bearing systems 38 about the engine central longitudinal axis A which is collinear with their longitudinal axes.

The core airflow is compressed by the low pressure compressor 44 then the high pressure compressor 52, mixed and burned with fuel in the combustor 56, then expanded over the high pressure turbine 54 and low pressure turbine 46. The turbines 46, 54 rotationally drive the respective low speed spool 30 and high speed spool 32 in response to the expansion. It will be appreciated that each of the positions of the fan section 22, compressor section 24, combustor section 26, turbine section 28, and fan drive gear system 48 may be varied. For example, gear system 48 may be located aft of combustor section 26 or even aft of turbine section 28, and fan section 22 may be positioned forward or aft of the location of gear system 48.

The engine 20 in one example is a high-bypass geared aircraft engine. In a further example, the engine 20 bypass ratio is greater than about six (6), with an example embodiment being greater than about ten (10), the geared architecture 48 is an epicyclic gear train, such as a planetary gear system or other gear system, with a gear reduction ratio of greater than about 2.3 and the low pressure turbine 46 has a pressure ratio that is greater than about five. In one disclosed embodiment, the engine 20 bypass ratio is greater than about ten (10:1), the fan diameter is significantly larger than that of the low pressure compressor 44, and the low pressure turbine 46 has a pressure ratio that is greater than about five 5:1. Low pressure turbine 46 pressure ratio is pressure measured prior to inlet of low pressure turbine 46 as related to the pressure at the outlet of the low pressure turbine 46 prior to an exhaust nozzle. The geared architecture 48 may be an epicycle gear train, such as a planetary gear system or other gear system, with a gear reduction ratio of greater than about 2.3:1. It should be understood, however, that the above parameters are only exemplary of one embodiment of a geared architecture engine and that the present disclosure is applicable to other gas turbine engines including direct drive turbofans.

A significant amount of thrust is provided by the bypass flow B due to the high bypass ratio. The fan section 22 of the engine 20 is designed for a particular flight condition—typically cruise at about 0.8 Mach and about 35,000 feet (10,688 meters). The flight condition of 0.8 Mach and 35,000 ft (10,688 meters), with the engine at its best fuel consumption—also known as "bucket cruise Thrust Specific Fuel Consumption ('TSFC')"—is the industry standard parameter of lbm of fuel being burned divided by lbf of thrust the engine produces at that minimum point. "Low fan pressure ratio" is the pressure ratio across the fan blade alone, without a Fan Exit Guide Vane ("FEGV") system. The low fan pressure ratio as disclosed herein according to one non-limiting embodiment is less than about 1.45. "Low corrected fan tip speed" is the actual fan tip speed in ft/sec divided by an industry standard temperature correction of $[(\text{Tram}\ ^\circ\ \text{R})/(518.7^\circ\ \text{R})]^{0.5}$. The "Low corrected fan tip speed" as disclosed herein according to one non-limiting embodiment is less than about 1150 ft/second (350.5 m/sec).

Figure 2:
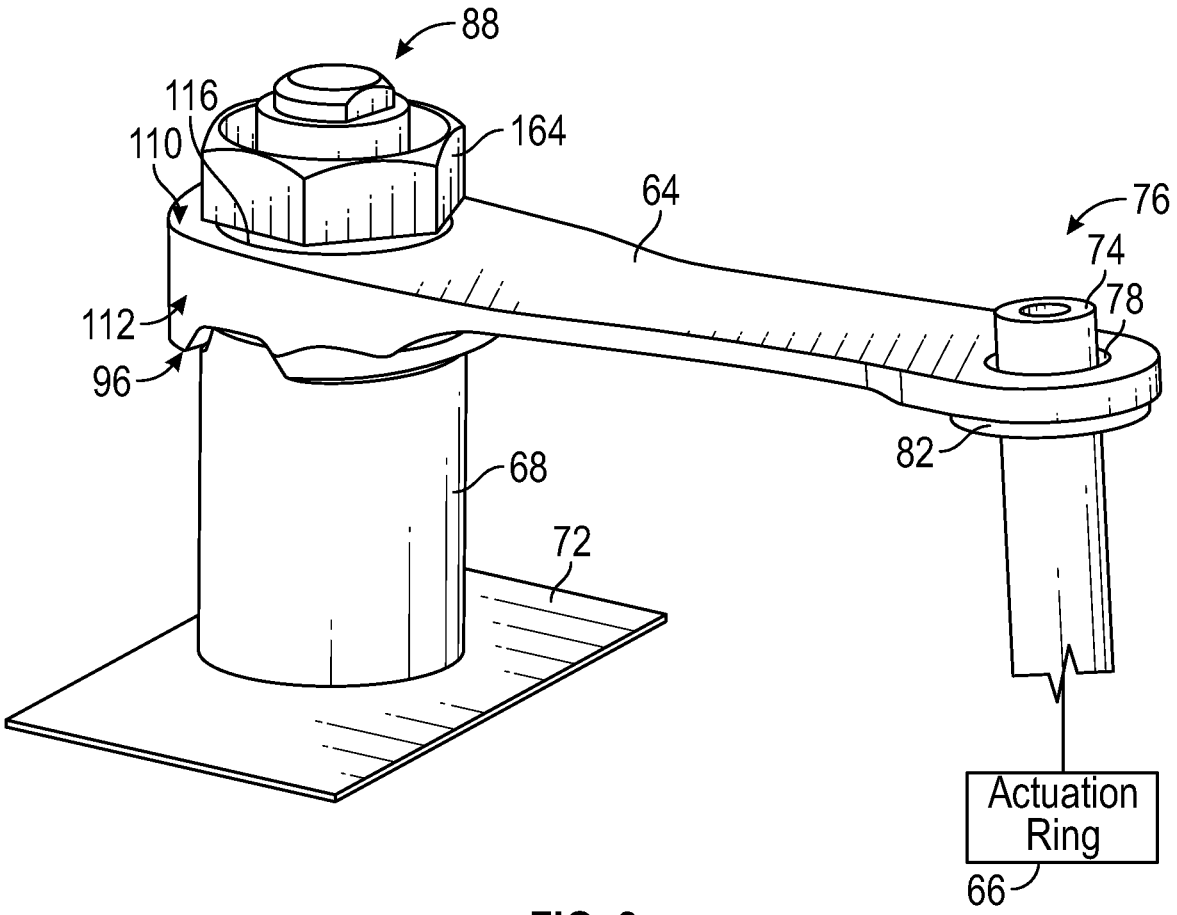
FIG. 2 illustrates a perspective view of a variable vane arm used within the engine of FIG. 1, in accordance with an embodiment of the disclosure.
Figure 3:
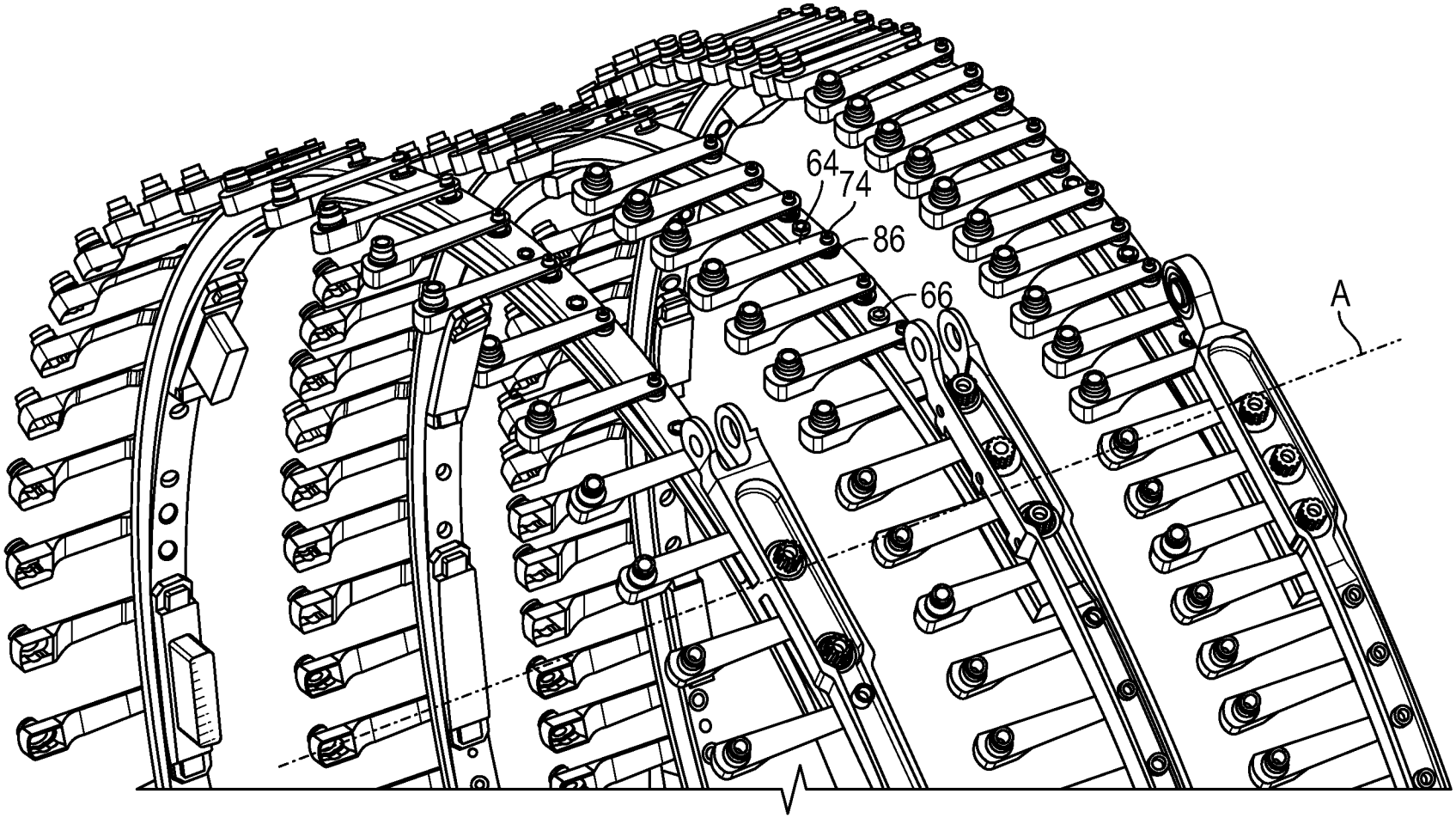
FIG. 3 illustrates actuation rings used in connection with the system of FIG. 2, in accordance with an embodiment of the disclosure.

Referring now to FIGS. 2-3 with continued reference to FIG. 1. FIGS. 2-3 illustrate a vane arm 64 coupling an actuation ring 66. It is understood that although discussed as a single actuation ring 66, the actuation ring 66 may be composed of multiple components integrally formed or connected. Rotating the actuation ring 66 circumferentially about the axis A moves the vane arm 64 to pivot a vane stem 68, and an associated variable vane 72. The example vane arm 64 is used to manipulate variable guide vanes in the high pressure compressor section 52 of the engine 20 of FIG. 1.

The disclosed vane arm 64 includes a radially inward facing surface 96 and a radially outward facing surface 110 opposite the radially inward facing surface 96. An aperture 116 extends from the radially inward surface 96 to the radially outward surface 110. The disclosed vane arm 64 includes side surfaces 112 located at the vane stem end 88. The side surfaces 112 extends radially to connect edges of the radially outward facing surface 110 to edges of the radially inward facing surface 96. In an embodiment, the side surfaces 112 may be flat.

The vane arm 64 includes a vane pin end 76 and a vane stem end 88 opposite the vane pin end 76. The aperture 116 is located in vane arm 64 at the vane stem end 88. A portion of the vane stem 68 is inserted into the aperture 116 and the vane stem 68 is secured to the vane arm 64 via a fastening mechanism 164. The fastening mechanism 164 may be a nut, as shown in FIG. 2. The vane arm 64 and vane stem 68 rotate in unison A pin 74 is attached to the vane pin end 76 of the vane arm 64. The example pin 74 and vane arm 64 rotate together. In this example, the pin 74 is received within an aperture 78 and then swaged to hold the pin 74 relative to the vane arm 64. A collar 82 of the pin 74 may contact the vane arm 64 during assembly to ensure that the pin 74 is inserted to an appropriate depth prior to swaging. The pin 74 is radially received within a sync ring bushing 86, which is received within a sleeve (not shown) within the actuation (or sync) ring 66. The bushing 86 permits the pin 74 and the vane arm 64 to rotate together relative to the actuation ring 66. As illustrated in FIG. 3, the pin 74 may be oriented relative to the vane arm 64 such that the pin 74 extends radially toward the axis A.

Figure 4:
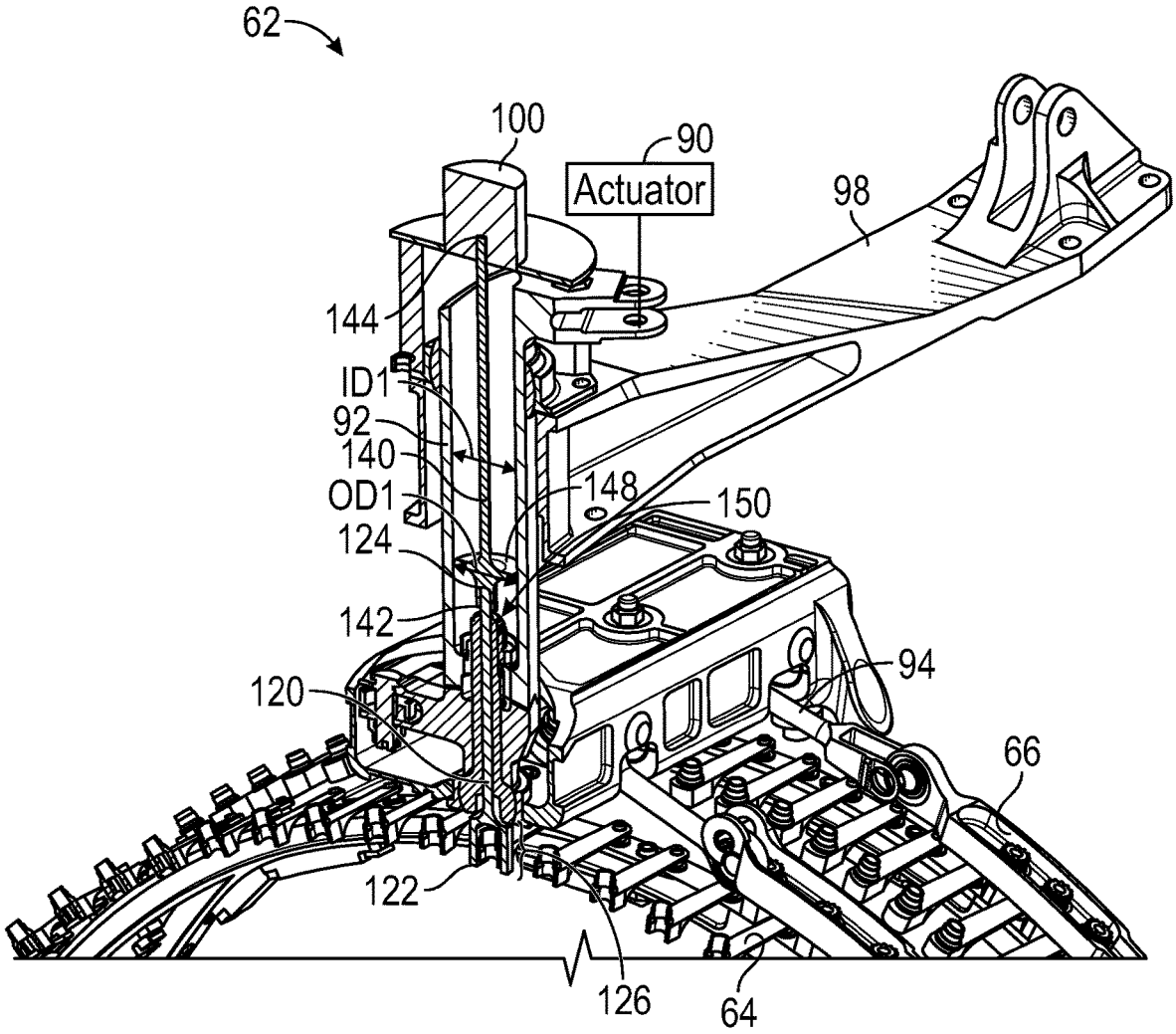
FIG. 4 illustrates a perspective view of a variable vane actuation system used within the engine of FIG. 1, in accordance with an embodiment of the disclosure.

Referring now to FIG. 4 with continued reference to FIGS. 1-3. FIG. 4 illustrates an example variable vane actuation system 62. An actuator 90 is operably connected to the actuation ring 66, through a torque tube 92 and a series of mechanical linkages 94. Due to excessive heat of the gas turbine engine 20, the actuator 90 may be located outside of the engine casing 98. In the embodiment illustrated in FIG. 4, the actuator 90 is configured to rotate the torque tube 92 and the rotation of the torque tube 92 rotates the actuation rings 66 circumferentially about the axis A through the series of mechanical linages 94, which moves the vane arm 64 to pivot the vane stem 68, and an associated variable vane 72.

In an embodiment, the actuator 90 is liner actuator. Conventionally, a linear variable differential transformer (LVDT) may be used to measure an amount of stroke of the actuator 90 when the actuator is a linear actuator. A predicted amount of variable vane 72 rotation may be calculated based upon as the predicted kinematic movement of the torque tube 92, the series of linkages 94, the actuation rings 66, vane arm 64, vane stem 68, and variable vane 72 as a function of the stroke measurement of the LVDT. The predicted kinematic movement may be based upon the relative connections (e.g., structural deflections and mechanical slop) between the torque tube 92, the series of linkages 94, the actuation rings 66, vane arm 64, vane stem 68, and variable vane 72. The predicted displacement may also be based upon a size of the components in the kinematic chain including the torque tube 92, the series of linkages 94, the actuation rings 66, vane arm 64, vane stem 68, and variable vane 72. Tolerance ranges in the size of the components and thermal expansion/contraction affecting the size of each component in the kinematic chain may create difficultly in being able to accurately predict the amount of variable vane 72 rotation for a given amount of linear stroke of the actuator 90. As the number of components in the kinematic chain increases, so does the difficultly in being able to accurately predict the amount of variable vane 72 rotation for an amount of linear stroke of the actuator 90. Embodiments herein, seek to address the difficulty in predicting the amount of variable vane 72 rotation for a given amount of linear stroke of the actuator 90.

In an embodiment, a rotational variable differential transformer (RVDT) 100 is operably connected to the vane stem 68. The RVDT 100 is configured to detect an amount of rotation (e.g., angle of rotation) of the vane stem 68. Advantageously, by directly measuring the amount of rotation of the vane stem 68 at the actual vane stem 68, the process of calculating the predicted displacement of all the components in the kinematic chain is eliminated, thus reducing errors due to variables such as thermal expansion, tolerance ranges, structural deflections, mechanical slop, tolerance ranges, etc.

In an embodiment, the RVDT 100 is located outside of the engine casing 98 due to excessive heat of the gas turbine engine 20. The RVDT 100 may be connected to the vane stem 68 through one or more shafts 120, 140. In an embodiment, the one or more shaft 120, 140 pass through the torque tube 92 to operably connect the RVDT 100 to the vane stem 68. Advantageously, by passing the one or more shaft 120, 140 through the torque tube 92 to operably connect the RVDT 100 to the vane stem 68, no additional disturbance or blockages to airflow stream within the core flow path C of the gas turbine engine 20 are required. In the embodiment illustrated in FIG. 4, the RVDT 100 may be connected to the vane stem 68 through a first shaft 120 and a second shaft 140. The first shaft 120 and the second shaft 140 pass through the torque tube 92, as shown in FIG. 4. The first shaft 120 includes a first end 122 and a second end 124 opposite the first end 122. The first shaft 120 may be primarily cylindrical in shape. The first shaft 120 operably connects to the vane stem 68 at the first end 122 of the first shaft 120. The first end 122 may include a tubular portion 126 configured to fit around the vane stem end 88 of the vane arm 64, such that a portion of the vane stem end 88 is contained within the tubular portion 126. The tubular portion 126 is configured to interlock around the vane stem end 88 of the vane arm 64 such that as the vane arm 64 rotates the vane stem 68, the tubular portion 126 rotates as well, thus the tubular portion 126 will rotate with the vane stem 68. In an embodiment, the side surfaces 112 of the vane arm 64 may interlock with the vane tubular portion 126. The rotational torque is transferred from the tubular portion 126 of the first shaft 120 through the first shaft 120 and to the second end 124 of the first shaft 120. The first shaft 120 is operably connected to the second shaft 140 at the second end 124 of the first shaft 120.

The second shaft 140 may be primarily cylindrical in shape. The second shaft 140 includes a first end 142 and a second end 144 opposite the first end 142. The second end 144 of the second shaft 140 operably connects the second shaft 140 to the RVDT. The first end 142 of the second shaft 140 operably connects the second shaft 140 to the second end 124 of the first shaft 120. In an embodiment, the first end 142 of the second shaft 140 and the second end 124 of the first shaft 120 may operably connect to form a spline joint 150. In an embodiment, the first end 142 of the second shaft 140 is a female portion of the spline joint 150 and the second end 124 of the first shaft 120 is a male portion of the spline joint 150 that operably connects to the female portion, as seen in FIG. 4. Advantageously, the spline joint 150 allows for sliding between the first shaft 120 and the second shaft 140 due to thermals and deflections. The second shaft 140 may also include a circular body 148. The circular body 148 may be formed from the second shaft 140 or operably connected to the second shaft 140. In an embodiment, the circular body 148 may be concentric with the second shaft 148. The circular body 148 may be located proximate the first end 142 of the second shaft 140. In an embodiment, the circular body 148 has an outer diameter OD1 about equal to or less than an inner diameter ID1 of the torque tube 92. The purpose of this circular body 148 is to center align the extension rod 144 within the torque tube 92 because the spline joint 150 is a blind assembly and thus may be difficult to visually assemble. Advantageously, the circular body 148 may help during assembly by centering the second shaft 140 within the torque tube 92 enabling the second shaft 140 to connect with the first shaft 120.

Figure 5:
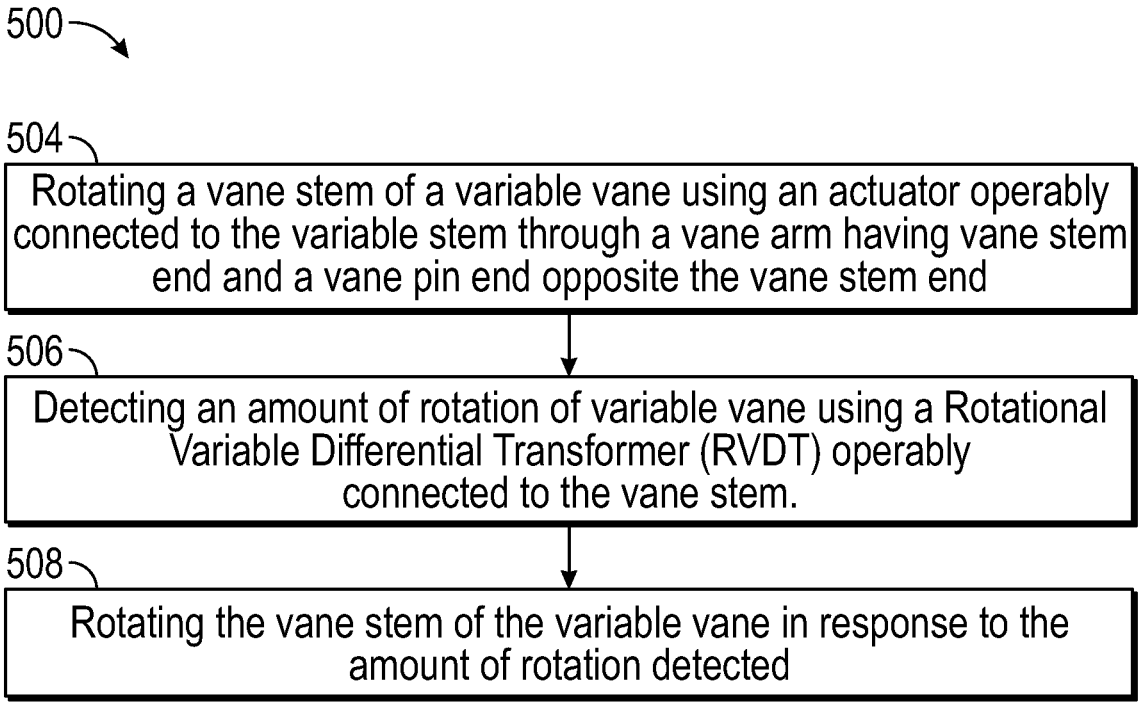
FIG. 5 is a diagram of a method of controlling airflow through a core flow path of a gas turbine engine, showing operations of the method, according to an embodiment of the present disclosure.

Referring not to FIG. 5 with continued reference to FIGS. 1-4. FIG. 5 illustrated a method 500 of controlling airflow through a core flow path C of a gas turbine engine 20. At block 504, a vane stem 68 of a variable vane 72 is rotated using an actuator 90 operably connected to the vane stem 68 through a vane arm 64 having vane stem end 88 and a vane pin end 72 opposite the vane stem end 88. The vane arm 64 being operably connected to the vane stem 68 at the vane stem end 88 and the vane arm 64 being operably connected to the actuator 90 at the vane pin end 76. As mentioned above, the variable vane 72 rotates with the vane stem 68. At block 506, an amount of rotation of the variable vane 72 is detected using a RVDT 100 operably connected to the vane stem 68. At block 508, the vane stem 68 of the variable vane 72 is rotated in response to the amount of rotation detected.

While the above description has described the flow process of FIG. 5 in a particular order, it should be appreciated that unless otherwise specifically required in the attached claims that the ordering of the steps may be varied.

Technical effects of embodiments of the present disclosure include detecting an amount of rotation of a vane utilizing a RVDT operably connected to the vane stem.

The term "about" is intended to include the degree of error associated with measurement of the particular quantity based upon the equipment available at the time of filing the application.

The terminology used herein is for the purpose of describing particular embodiments only and is not intended to be limiting of the present disclosure. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, element components, and/or groups thereof.

While the present disclosure has been described with reference to an exemplary embodiment or embodiments, it will be understood by those skilled in the art that various changes may be made and equivalents may be substituted for elements thereof without departing from the scope of the present disclosure. In addition, many modifications may be made to adapt a particular situation or material to the teachings of the present disclosure without departing from the essential scope thereof. Therefore, it is intended that the present disclosure not be limited to the particular embodiment disclosed as the best mode contemplated for carrying out this present disclosure, but that the present disclosure will include all embodiments falling within the scope of the claims.

What is claimed is:

1. A variable vane actuation system of a gas turbine engine, comprising:

a variable vane;

a vane stem operably associated with the variable vane, wherein the variable vane is configured to rotate with the vane stem;

a vane arm having a vane stem end and a vane pin end opposite the vane stem end, the vane arm being operably connected to the vane stem at the vane stem end;

a pin attached to the vane pin end of the vane arm;

a rotational variable differential transformer operably connected to the vane stem, the rotational variable differential transformer configured to detect an amount of rotation of the vane stem;

an actuator operably connected to the vane arm at the vane pin end;

a torque tuber operably connected to the actuator;

a series of mechanical linkages operably connected to the torque tube; and an actuation ring operably connecting the series of mechanical linkages to the vane arm at the vane pin end, wherein the rotational variable differential transformer is operably connected to the vane stem through one or more shafts passing through the torque tube.

2. The variable vane actuation system of claim 1, wherein the actuator is configured to be located outside of an engine casing.

3. The variable vane actuation system of claim 1, wherein the actuator is a linear actuator.

4. The variable vane actuation system of claim 1, wherein the rotational variable differential transformer is configured to be located outside of an engine casing.

5. The variable vane actuation system of claim 1, wherein the rotational variable differential transformer is operably connected to the vane stem through one or more shafts.

6. The variable vane actuation system of claim 1, further comprising:

a first shaft operably connected to the vane stem; and a second shaft operably connecting the first shaft to the rotational variable differential transformer.

7. The variable vane actuation system of claim 6, wherein the first shaft and the second shaft pass through the torque tube.

8. The variable vane actuation system of claim 6, wherein the first shaft further comprises:

a first end operably connected to the vane stem; and a second end opposite the first end operably connecting the first shaft to the second shaft, and wherein the second shaft further comprises:

a first end of the second shaft operably connected to the second end of the first shaft; and a second end of the second shaft opposite the first end of the second shaft, the second end of the second shaft operably connecting the second shaft to the rotational variable differential transformer.

9. The variable vane actuation system of claim 8, wherein the first end of the second shaft and the second end of the first shaft operably connect to form a spline joint.

10. The variable vane actuation system of claim 9, wherein the first end of the second shaft is a female portion of the spline joint and the second end of the first shaft is a male portion of the spline joint that operably connects to the female portion.

11. The variable vane actuation system of claim 8, wherein the first shaft is operably connected to the vane stem through the vane stem end of the vane arm.

12. The variable vane actuation system of claim 11, wherein the first shaft further comprises:

a tubular portion located at the first end of the first shaft, the tubular portion being configured to fit around the vane stem end of the vane arm, wherein a portion of the vane stem end is contained within the tubular portion.

13. The variable vane actuation system of claim 12, wherein the tubular portion is configured to interlock around the vane stem end of the vane arm such that the tubular portion will rotate with the vane stem as the vane arm rotates the vane stem.

14. The variable vane actuation system of claim 7, wherein the second shaft includes a circular body having an outer diameter about equal to or less than an inner diameter of the torque tube.

15. The variable vane actuation system of claim 14, wherein the first shaft further comprises:

a first end operably connected to the vane stem; and a second end opposite the first end operably connecting the first shaft to the second shaft, wherein the second shaft further comprises:

a first end of the second shaft operably connected to the second end of the first shaft; and a second end of the second shaft opposite the first end of the second shaft, the second end of the second shaft operably connecting the second shaft to the rotational variable differential transformer, and wherein the circular body is located proximate the first end of the second shaft.

16. The variable vane actuation system of claim 14, wherein the circular body is concentric with the second shaft.

17. A method of controlling airflow through a core flow path of a gas turbine engine, the method comprising:

rotating a vane stem of a variable vane using an actuator operably connected to the vane stem through a vane arm having a vane stem end and a vane pin end opposite the vane stem end, the vane arm being operably connected to the vane stem at the vane stem end and the vane arm being operably connected to the actuator at the vane pin end, wherein the variable vane rotates with the vane stem;

detecting an amount of rotation of the variable vane using a rotational variable differential transformer operably connected to the vane stem; and rotating the vane stem of the variable vane in response to the amount of rotation detected, wherein a torque tuber is operably connected to the actuator, and wherein the rotational variable differential transformer is operably connected to the vane stem through one or more shafts passing through the torque tube.

* * * * *